US007460820B2

(12) United States Patent
Okabe

(10) Patent No.: US 7,460,820 B2
(45) Date of Patent: Dec. 2, 2008

(54) DRIVE CONTROL DEVICE AND IMAGE FORMING APPARATUS

(75) Inventor: Shouji Okabe, Kanagawa (JP)

(73) Assignee: Ricoh Company Limited, Tokyo (JP)

( * ) Notice: Subject to any disclaimer, the term of this patent is extended or adjusted under 35 U.S.C. 154(b) by 210 days.

(21) Appl. No.: 11/476,837

(22) Filed: Jun. 29, 2006

(65) Prior Publication Data

US 2007/0009290 A1 Jan. 11, 2007

(30) Foreign Application Priority Data

Jul. 7, 2005 (JP) ..... 2005-198900
Jun. 16, 2006 (JP) ..... 2006-167992

(51) Int. Cl.
*G03G 15/00* (2006.01)
*G03G 15/16* (2006.01)

(52) U.S. Cl. ..... 399/301; 399/167; 399/302

(58) Field of Classification Search ..... 399/301, 399/167, 162, 302, 75; 198/804, 810.01
See application file for complete search history.

(56) References Cited

U.S. PATENT DOCUMENTS 7,263,321 B2 * 8/2007 Inui et al. ..... 399/301 X
2002/0012549 A1 * 1/2002 Oku ..... 399/167
2003/0002887 A1 * 1/2003 Imaizumi et al. ..... 399/167
2004/0184828 A1 * 9/2004 Bannai et al. ..... 399/301 X
2006/0153604 A1 * 7/2006 Matsuda et al. ..... 399/301

FOREIGN PATENT DOCUMENTS

JP 2000-047547 2/2000
JP 2004-205717 7/2004

OTHER PUBLICATIONS

Machine translation of JP 2000-047547 A dated Mar. 17, 2008.*
Machine translation of JP 2004-205717 A dated Mar. 17, 2008.*

* cited by examiner

*Primary Examiner*—Sophia S Chen
(74) *Attorney, Agent, or Firm*—Harness, Dickey & Pierce, P.L.C.

(57) ABSTRACT

A drive control device controls a rotation speed of a rotatable member. A rotation drive member drives the rotatable member. A plurality of objects to be detected are provided in the rotatable member. A detector detects the objects to be detected, which are rotating with rotation of the rotatable member, and outputs a detection signal. A control part detects an angular speed of the rotatable member in accordance with the detection signal, and controls a rotation speed of the rotation drive member. The control part calculates an amount of error in intervals of the objects to be detected, and controls the rotation speed of the rotation drive member in accordance with the amount of error.

9 Claims, 8 Drawing Sheets

DRIVE CONTROL DEVICE AND IMAGE FORMING APPARATUS

BACKGROUND OF THE INVENTION

1. Field of the Invention

The present invention relates to drive control devices and image forming apparatuses such as a facsimile machine, a printer, a copy machine, etc, which uses a rotating object and, more particularly, to an image forming apparatus using an intermediate transfer member, which transfers a visible image on an image carrier to a movable object at a position where the image carrier opposes the movable object.

2. Description of the Related Art

There is known an image forming apparatus, especially a color image forming apparatus, which has a plurality of development units and an intermediate transfer belt. In an image forming apparatus of this type, it is known that a fluctuation in a conveyance speed of the intermediate transfer belt causes a color shift in a color image. Such a fluctuation in a conveyance speed may be caused by a fluctuation in rotation of a drive roller, which drives the intermediate transfer belt, due to eccentricity of the drive roller, thermal expansion of the drive roller, a load to the intermediate transfer belt during conveyance of a recording medium, a load to the intermediate transfer belt in a primary transfer bias of a photosensitive drum, or the like. One of causes of such a color shift is in that a plurality of color toner images are shifted from each other when overlapping each color image on the intermediate transfer belt. In order to eliminate such a color shift, there are suggested several methods to reduce a fluctuation in a speed of the intermediate transfer belt. As one of the methods, there is a method to correct a rotation fluctuation of a drive roller by using a rotary encoder provided to an idle roller of the intermediate transfer belt for detecting an angular speed. The rotary encoder used for this method comprises, for example, a disk concentrically provided to a rotational shaft of the idle roller, and a transmission-type photo-interrupter sandwiching the disk. The disk is provided with many slits arranged radially. The photo-interrupter detects a light passing through the slits so as to detect a pulse time of a pulse signal generated by the detection of the light. A conveyance speed of the intermediate transfer belt is calculated based on the detected value so as to perform a feedback control of the rotation of the drive roller.

As an image forming apparatus using the above-mentioned encoder, there is known an invention disclosed in Patent Document 1 or Patent Document 2. Patent Document 1 discloses a technique to eliminate a belt moving speed fluctuation due to eccentricity of a roller without using a filter. According to this technique, angular velocity information of an idle roller detected from a pulse signal from an encoder is stored in a first memory over one rotation period of a drive roller. Then, a speed detection error component due to eccentricity of the idle roller is extracted by canceling a speed fluctuation component due to eccentricity of the drive roller by operation of an operation circuit in the angular velocity information stored in the first memory, and the extracted speed detection error component is stored in a second memory. During image formation, a difference circuit acquires a difference between the angular velocity information of the idle roller detected from the pulse signal from the encoder and the speed detection error component stored in the second memory. Then, based on the difference data, a comparing circuit outputs a control signal to a motor driver so as to control the belt moving speed.

Patent Document 2 discloses an image forming apparatus capable of providing an excellent control result even if an encoder having a physically low resolution is used. The image forming apparatus comprises an image forming means for forming an image on a recording paper by forming a latent image on a photosensitive member by exposure and developing, transferring and fixing the latent image, a moving means used for a transferring process, and a drive means for rotationally driving the moving means. Moving distance information or moving speed information of the moving means is detected by an encoder. A position deflection or a speed deflection is acquired from an output of the encoder so as to perform a predetermined operation on the position deflection or the speed deflection. A drive source is controlled based on the result of the operation. In this image forming apparatus, a count is carried out at a predetermined period T within an output section of the encoder.

Patent Document 1: Japanese Laid-Open Patent Application No. 2000-047547

Patent Document 2: Japanese Laid-Open Patent Application No. 2004-205717

However, if widths of the slits of the rotary encoder are not uniform and intervals of the slits are not uniform, variation in the slit width and variation in the slit interval are recognized as variation in the speed of the intermediate transfer belt. Thus, it is required to maintain processing accuracy and position accuracy at a high level when forming the slits, which drives up costs in manufacturing. It is very much difficult to fabricate the slits with completely uniform slit intervals.

Moreover, while determining an amount of error in intervals of slits (objects to be detected) provided radially, speed fluctuation due to various loads to the intermediate transfer belt may be included in the amount of error. Thus, the intervals of the objects to be detected must always correspond to the amount of error. That is, it is necessary to completely grasp at which position it is stopped between the objects to be detected even when the intermediate transfer belt stops. However, if a user removes the intermediate transfer unit and moves the intermediate transfer belt, the corresponding relationship therebetween goes out of order. Additionally, a noise may enter the detection signal, which indicates intervals of the objects to be detected while the intermediate transfer belt is rotated, and if an error occurs in detection of the objects to be detected, it is possible that the correspondence cannot be acquired.

SUMMARY OF THE INVENTION

It is a general object of the present invention to provide an improved and useful drive control device and image forming apparatus in which the above-mentioned problems are eliminated.

A more specific object of the present invention is to provide a drive control device and an image forming apparatus, which eliminate necessity of having uniformly equal interval between objects to be detected such as slits to allow formation of the objects to be detected at a low cost, and to achieve an accurate control of a rotating member even if such slits are used.

In order to achieve the above-mentioned objects, there is provided according to one aspect of the present invention a drive control device for controlling a rotation speed of a rotatable member, comprising: a rotation drive member that drives the rotatable member; a plurality of objects to be detected provided in the rotatable member; a detector that detects the objects to be detected, which are rotating with rotation of the rotatable member, and outputs a detection signal; and a control part that detects an angular speed of the rotatable member in accordance with the detection signal, and controls a rotation speed of the rotation drive member, wherein the control part calculates an amount of error in intervals of the objects to be detected, and controls the rotation speed of the rotation drive member in accordance with the amount of error.

Additionally, there is provided according to another aspect of the present invention an image forming apparatus comprising: an intermediate transfer belt that is a rotatable endless belt and onto which a toner image is transferred as a primary transfer image; a drive roller that drives the intermediate transfer belt; a driven roller that rotates with movement of the intermediate transfer belt; a plurality of objects to be detected that rotate together with the driven roller; and a detector that detects the objects to be detected and outputs a detection signal, wherein said image forming apparatus transfers the primary transfer image that has been transferred onto the intermediate transfer belt onto a recording medium so as to form a secondary transfer image on the recording medium, said image forming apparatus further comprising a control part that detects an angular speed of the driven roller in accordance with the detection signal and controls a rotation speed of the drive roller in accordance with the angular speed, the control part calculating an amount of error in intervals of the objects to be detected so as to control a rotation speed of the drive roller in accordance with the amount of error.

According to the present invention, the amount of error in the intervals of the objects to be detected, and the rotation speed of the rotation drive member is controlled while correcting the moving time corresponding to each interval by a time corresponding to the amount of error. Thus, there is no need to make the intervals of the objects to be detected to be uniformly equal intervals, which enables formation of the objects to be detected at a low cost. Additionally, the rotation speed of the rotation drive member can be controlled accurately.

Other objects, features and advantages of the present invention will become more apparent from the following detailed description when read in conjunction with the accompanying drawings.

DETAILED DESCRIPTION OF THE PREFERRED EMBODIMENTS

A description will now be given, with reference to the drawings, of an embodiment of the present invention.

Figure 1:
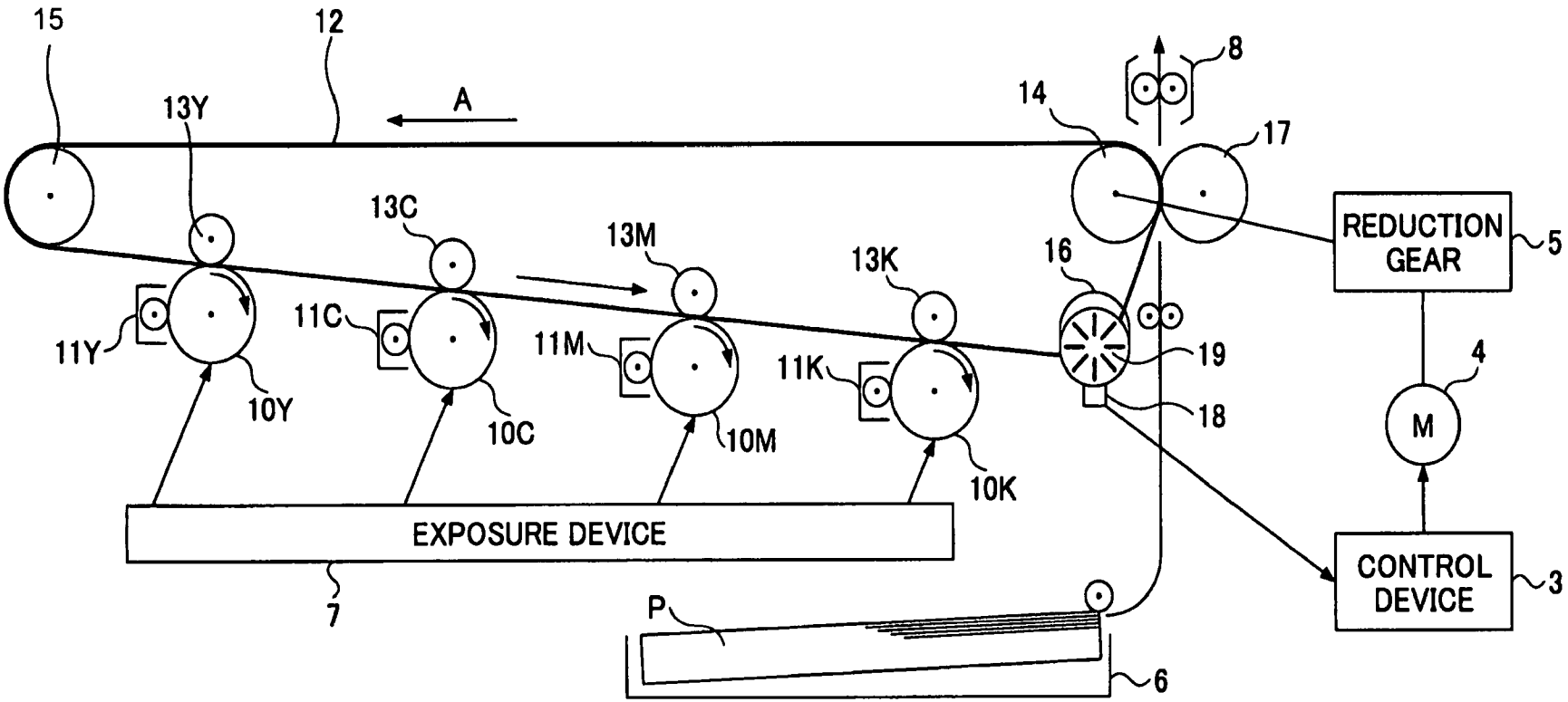
FIG. 1 is an illustration of an intermediate transfer unit of a full-color image forming apparatus according to an embodiment of the present invention.

FIG. 1 is an illustration of an intermediate transfer unit of a full-color image forming apparatus according to an embodiment of the present invention. The intermediate transfer unit shown in FIG. 1 comprises photosensitive drums 10Y, 10C, 10M and 10K, which are four image carriers, four development units 11Y, 11C, 11M and 11K, which develop latent images formed on the respective photosensitive drums to toner images having different color from each other, and an intermediate transfer belt 12 rotatable in a direction of an arrow A, the different color toner images being primarily transferred in an overlapping state. It should be noted that, in the following description, the suffixes Y, M, C, and K representing colors are omitted in reference numerals of components common to each color of Y, M, C and K.

The intermediate transfer belt 12 is an endless belt. In the present embodiment, the above-mentioned four photosensitive drums 10 for yellow, cyan, magenta and black are arranged in parallel under the intermediate transfer belt 12 and along a rotating direction of the intermediate transfer belt 12. Arranged around the photosensitive drums 10 are charge devices (not shown in the figure), the above-mentioned development units 11, primary transfer rollers 13Y, 13C, 13M and 13K constituting primary transfer devices, and cleaning units (not shown in the figure).

Laser lights corresponding to each color of yellow, cyan, magenta and black are irradiated by an exposure device 7 onto charge surfaces of the photosensitive drums 10 charged by the charge devices so that latent images are formed on surface portions of the photosensitive drums 10 irradiated by the laser lights, respectively. The primary transfer rollers 13 are arranged opposite to the photosensitive drums 10, respectively, and the intermediate transfer belt 12 rotates between the primary transfer rollers 13 and the photosensitive drums 10 in a sandwiched state. The intermediate transfer belt 12 is supported by a drive roller 14, a tension roller 15 and a driven roller 16. The drive roller as a rotation drive member is rotated in the direction of the arrow A by a drive motor 4 via a reduction gear 5. A secondary transfer roller 17 is arranged at a position opposite to the drive roller 14 with the intermediate transfer belt 12 sandwiched therebetween.

In the image forming apparatus according to the present embodiment, when a print operation is started, photosensitive drums 10 rotate clockwise in FIG. 1, and the surfaces thereof are uniformly charged by the charge devices. Lights corresponding to images of colors, yellow, cyan, magenta and black, are irradiated from the exposure device 7 onto the charged surfaces, respectively, and latent images are formed on the charged surfaces, respectively. The latent images are developed by the respective development units 11, and the latent images turn to toner images of colors, yellow, cyan, magenta and black. The toner images of each color are transferred onto the intermediate transfer belt 12 rotating in the direction of the arrow A by the respective primary transfer rollers 13 in an accurately overlapping state, and, thereby, a composite color image of full-color is formed on the intermediate transfer belt 12.

A transfer paper P, which is a recording medium, is fed at a predetermined timing from a paper supply unit 6 provided under the photosensitive drums 10. When the fed transfer paper P is conveyed between the drive roller 14 and the secondary transfer roller 17, the composite color image carried by the intermediate transfer belt 12 is transferred onto the transfer paper P by the secondary transfer roller 17. Then, the toner image on the transfer paper P is fixed by a fixation unit 8, and is ejected on a paper eject tray (not shown in the figure).

A disk 19 as a rotation plate is attached concentrically to the driven roller 16 as a rotatable member rotatable with rotation of the intermediate transfer belt 12. A plurality of slits, which are objects to be detected, are formed in the disk 19. It should be noted that although the driven roller 16 does not actually appear in FIG. 1 since the driven roller 16 is positioned on a backside of the disk 19, for the sake of convenience, the driven roller 16 is drawn as it protrudes upward from the disk 19.

An optical sensor 18 is provided near the disk with a fixed distance therebetween. The optical sensor 18 projects a measurement light to the disk 19, and receives the reflected light/transmitted light thereof so as to output a pulse-like detection signal. Then, a time period from a change point to a change point of the pulse-like detection signal is measured, and an angular speed or velocity of the driven roller 16, that is, a conveyance speed of the intermediate transfer belt 12 is detected from the measured time period. A control is performed so that the conveyance speed of the intermediate transfer belt 12 is maintained constant based on the detected conveyance speed. This control is performed by a control device 3 as a conveyance speed control means.

It should be noted that although the slits 19*a*, which are provided at generally equal intervals over the entire circumference of the disk 19, are used as the objects to be detected, grooves or notches provided on an end surface or an outer circumferential surface of the driven roller 16 may be used as the objects to be detected instead of the slits 19*a*. The objects to be detected correspond to radial reflection parts formed by printing when a reflection type optical sensor 18 (for example, a photo-reflector) is used. The objects to be detected correspond to elongated thorough holes (the slits 19*a* of the disk 19) formed radially when a transmission type optical sensor 18 (for example, a photo-interrupter) is used. It should be noted that, for example, a magnetic sensor may be used instead of the optical sensor 18. In such a case, hall elements, for example, as the objects to be detected may be provided at the same positions as the above-mentioned radial reflection parts.

The optical sensor 18 is provided to the driven roller 16 near the drive roller 14, which determines a conveyance speed of the intermediate transfer belt 12, and is configured to detect a conveyance speed close to an actual speed. A length of the outer circumference of the drive roller 14 is an even multiple of a length of the outer circumference of the driven roller 16. Hereinafter, a description will be given on the assumption that a ratio of the outer circumference of the drive roller 14 and the outer circumference of the driven roller 16 is 2:1.

Figure 2:
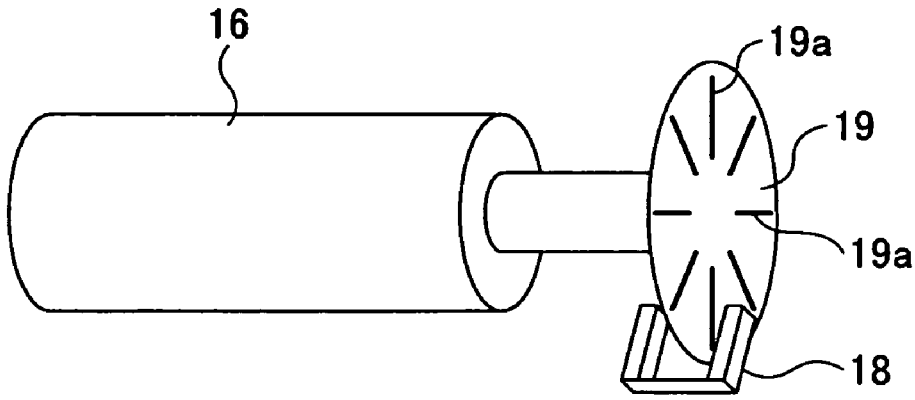
FIG. 2 is a perspective view of a driven roller, a disk and an optical sensor shown in FIG. 1.

FIG. 2 is a perspective view of the driven roller 16, the disk 19, the slits 19*a* as the objects to be detected formed in the disk 19, and the optical sensor 18 as a transmission type sensor. The exiting light from the light-emitting element of the optical sensor 18 as a detector is incident on a light-receiving element by passing through the slits (objects to be detected) 19*a*. A voltage generated in the light-receiving element is binarized by a voltage comparator so that a pulse signal is generated as the detection signal.

Figure 3:
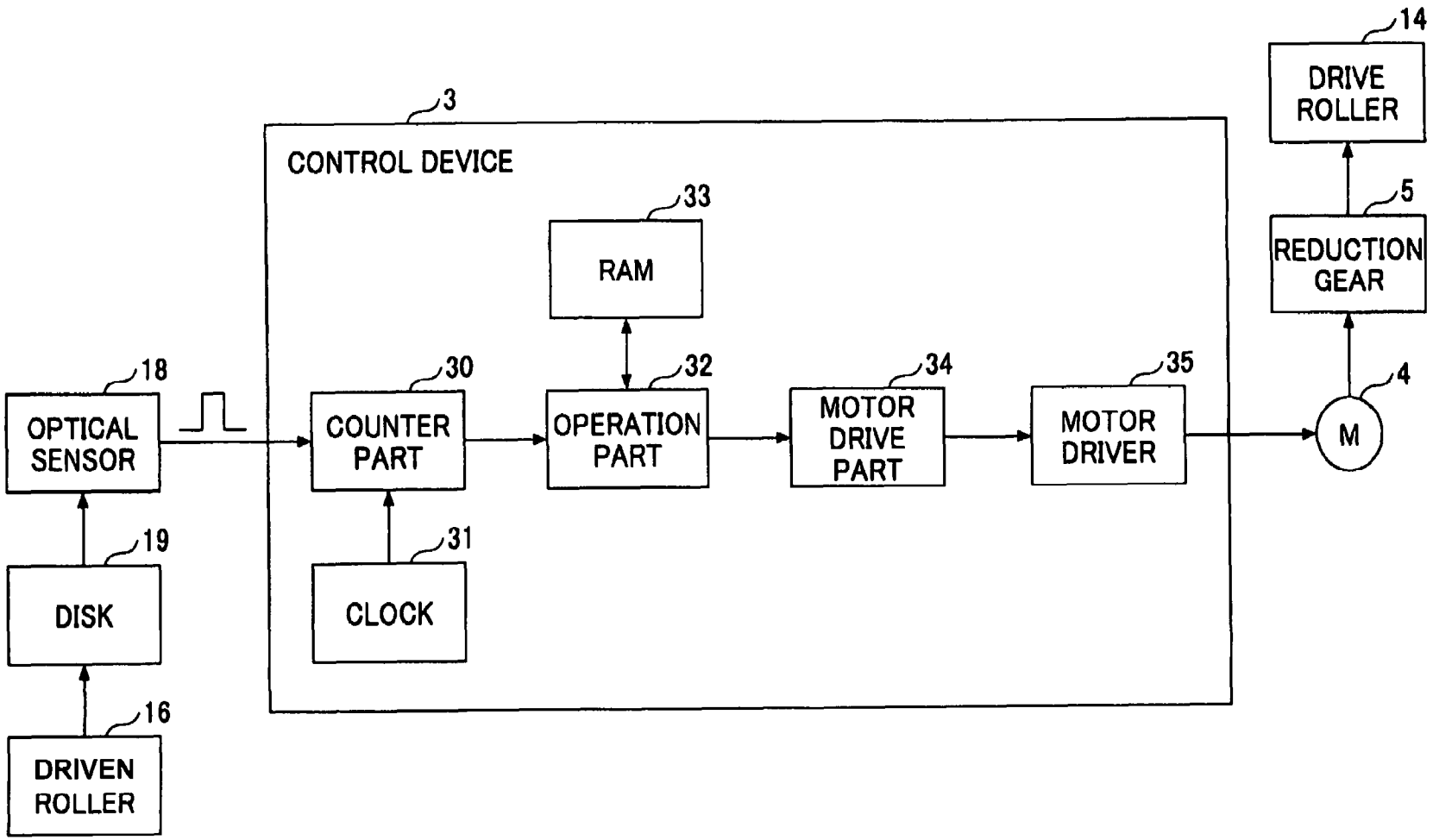
FIG. 3 is a block diagram of a control device shown in FIG. 1.

FIG. 3 is a block diagram of the control device 3, which is a control part provided in the image forming apparatus shown in FIG. 1. As mentioned above, a pulse signal of eight pulses is generated for each rotation of the driven roller 16. The control device 3 as a control part has a counter part 30, which counts a moving time period from rising to rising of pulses or from falling to falling of pulses according to a clock pulse supplied by a clock 31. The clock 31 generates a periodic clock pulses of a fixed time interval at a high frequency such as, for example, several hundreds KHz to several MHz. In the present embodiment, the clock 31 is constituted by a quartz oscillator. Additionally, the control device 3 comprises a RAM 33 for storing a count value of the moving time period, an operation part for acquiring an angular speed (moving speed) and acquiring a difference between the angular speed and a target speed so as to acquire a speed correction amount with which a constant speed is achieved, and a motor drive part 34 for outputting a motor drive clock, which is changed from a current speed, to a motor driver 35 based on the speed correction amount. A feedback coefficient (here, a PID efficient) necessary when acquiring the speed correction amount is stored in the RAM 33. The motor drive part 34 drives the drive motor 4 through the motor driver 35. A drive force of the drive motor 4 is transmitted to the drive roller 14 via the reduction gear 5.

Figure 4:
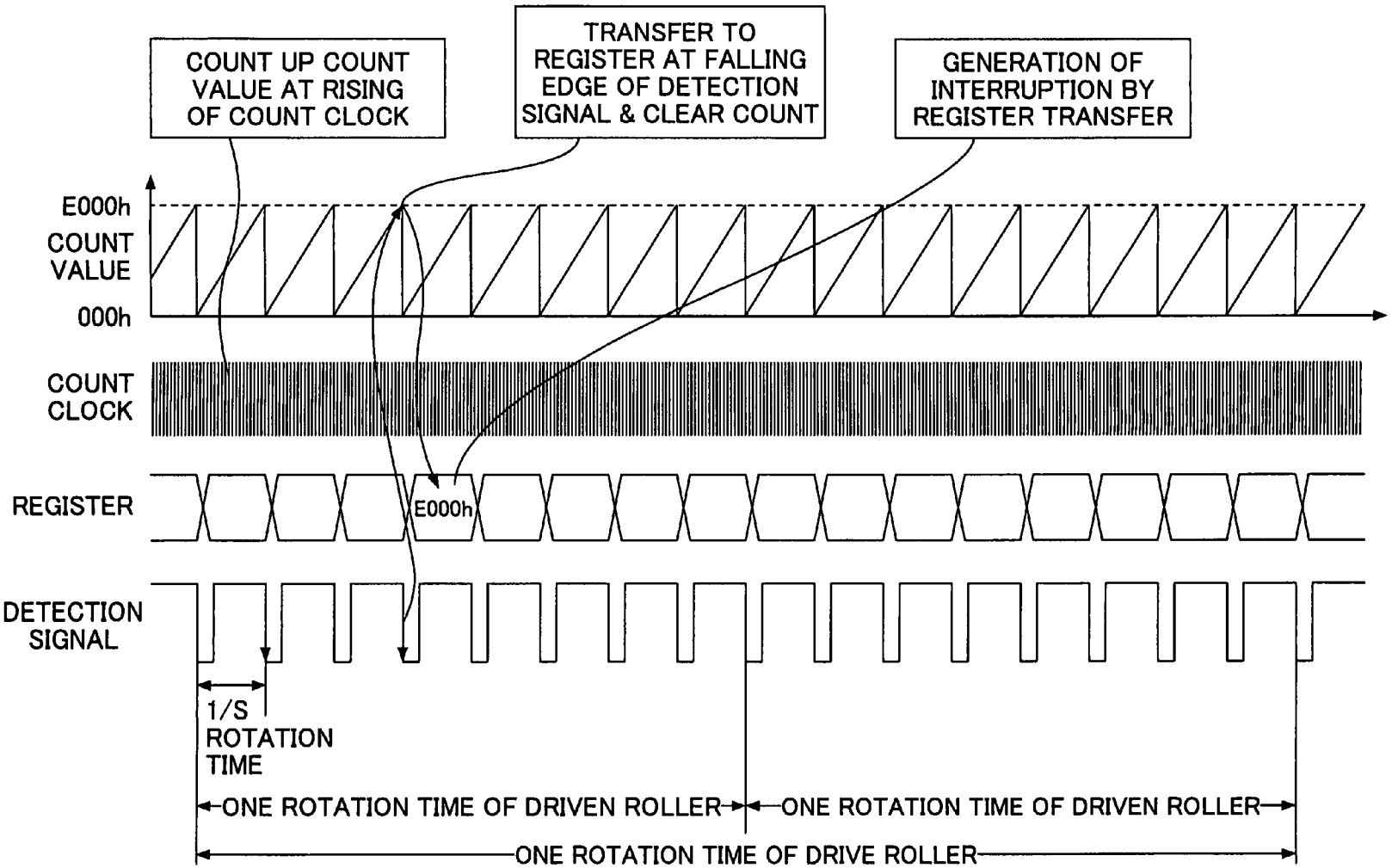
FIG. 4 is a timing chart of an operation of a counter part shown in FIG. 3.

FIG. 4 is a timing chart of an operation of the counter part 30 shown in FIG. 3. When a count is started by the counter part 30 at falling of the detection signal from the optical sensor 18, a count value goes up one by one at falling, for example, of the count clock from the clock 31. Then, when next falling of the detection signal is input, an interruption is generated, and the count value (E000h in the figure) at that time is transferred to a register of the operation part 32 and the count value is cleared and a predetermined operation process is started in the operation part 32. Then, a subsequent count is started. Here, the interruption means restarting count-up by clearing the counter.

The operation part 32 reads, if necessary, the count value from the register, and performs a predetermined operation process mentioned later. The count value between change points of the detection signal varies in accordance with an angular speed of the driven roller 16. Specifically, if the angular speed of the driven roller 16 becomes faster, the count value becomes smaller, and, contrary, if the angular speed becomes slower, the count value becomes larger. If the conveyance speed of the intermediate transfer belt 12 is constant and the slits 19*a* are arranged at uniformly equal intervals, the count value is always the same value. Moreover, if the slits 19*a* are arranged at uniformly equal intervals, an amount of change in the count value is proportional only to the conveyance speed of the intermediate transfer belt 12. However, it is impossible to make the slits 19*a* physically with completely uniform equal intervals, and an error is generated in the intervals to no small extent. Thus, an amount of such error is acquired according to a method mentioned later.

Figure 5:
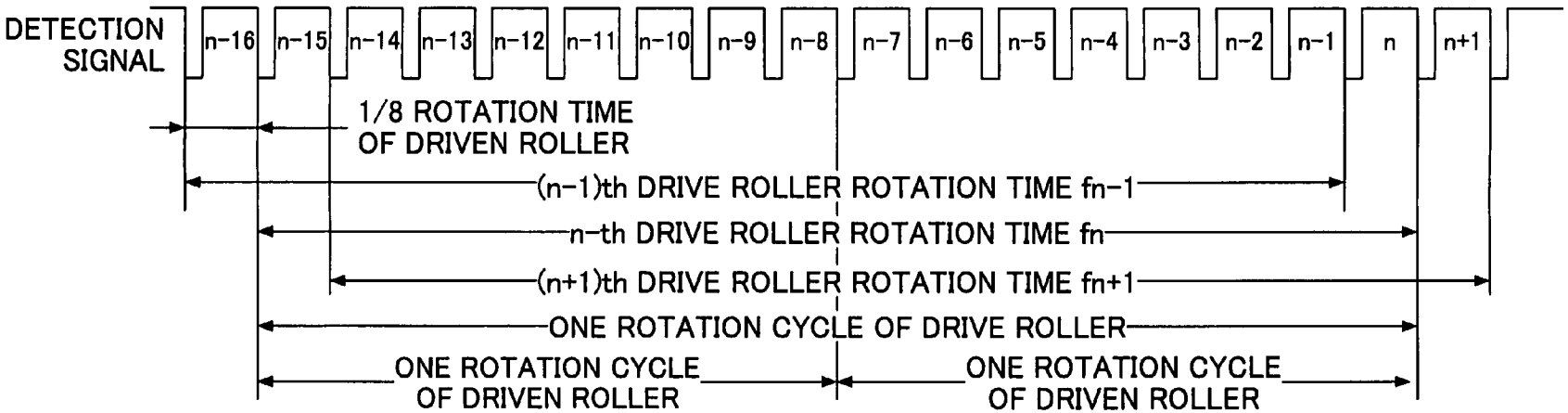
FIG. 5 is an illustration for explaining an operation of an operation part.

FIG. 5 is an illustration for explaining an operation of the operation part 32 during a period to determine the amount of error. If one of the pulses in the detection signal output from the optical sensor 18 is set to n-th pulse, first, count values of the last 16 times including the count value currently acquired of the moving time period of ⅛ rotation of the driven roller 16 are accumulated, and an angular speed (moving speed) is acquired from the accumulated value. Then, a difference between the angular speed and a target speed is acquired so as to acquire a speed correction amount, which causes a constant speed, and a speed control is performed in accordance with the thus-acquired speed correction amount. Subsequently, the same process is performed on the (n+1)th pulse, and the same process is sequentially performed also on the (n+2)th pulse, the (n+3)th pulse. By acquiring the speed correction amount from one rotation period of the drive roller 14, a control can be performed without influences of eccentricity of the drive roller 14. Additionally, a control can be performed with a small time by performing the control for each pulse. That is, the conveyance speed of the intermediate transfer belt 12 is controlled so that a speed fluctuation of the eccentricity component of the drive roller 14 remains and other speed components are made constant.

Figure 6:
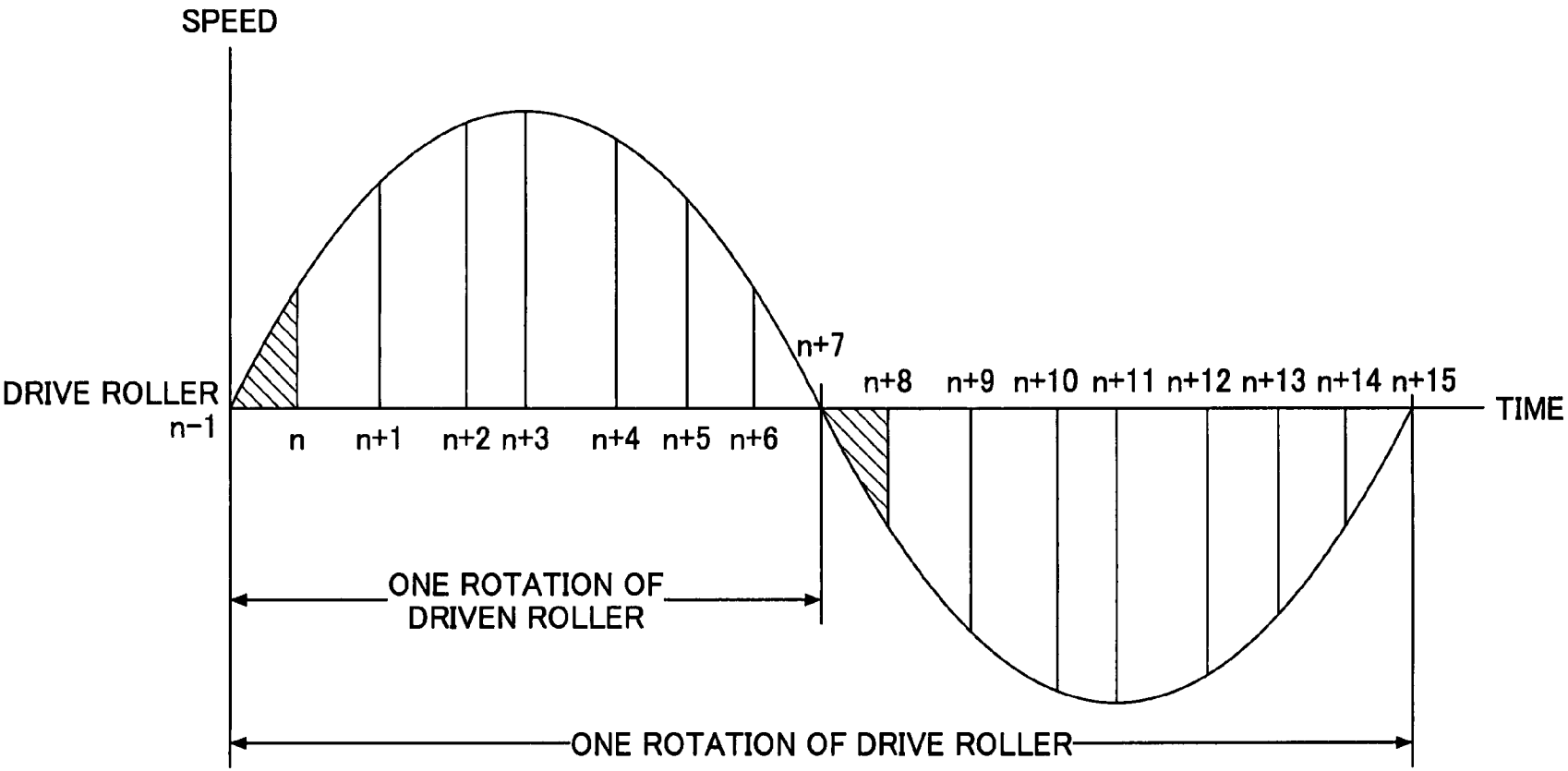
FIG. 6 is an illustration showing a speed fluctuation due to eccentricity of a drive roller and a canceling method of a speed component thereof.

FIG. 6 is an illustration showing a speed fluctuation due to eccentricity of the drive roller 14 and a canceling method of a speed component thereof. Here, the eccentricity of the drive roller means that the cross-sectional shape of the drive roller 14 is not a perfect circular form and, for example, it is an oblong form having a diameter in one direction longer than that in other directions. The eccentricity is one like a shape-error generated in a fabrication process of the drive roller, and it is very much difficult to form a roller having no eccentricity. Generally, an eccentric movement of a roller varies in accordance with a rotation cycle thereof as shown in FIG. 6. Accordingly, the speed fluctuation caused by the eccentricity of the drive roller 14 is detected as a detection error. Thus, the detection error due to the speed fluctuation can be cancelled by acquiring an integrated time of at least one rotation (for each rotation in the figure) of the drive roller 14, that is, the moving time period based on the count value for each rotation. Here, by making the outer circumference of the drive roller 14 to be an even multiple of the outer circumference of the driven roller 16, it becomes possible to cancel the speed component caused by the eccentricity of the drive roller 14 according to a method mentioned below when determining the amount of error mentioned later.

First, a half period of one period of rotation of the drive roller 14 corresponds to one rotation of the driven roller 16, and the outer circumferences are in the relationship of 1:2. Further, one of the pulses of the detection signal output from the optical sensor 18 is set as n-th pulse, and a number of sampling intervals in one rotation period of the driven roller 16 is set to 8. The sampling intervals slightly differs from each other in response to a physical interval error of the slits 19*a* as objects to be detected. Now, the moving time period of ⅛ rotation of the driven roller 16 at the n-th pulse and the moving time period of ⅛ rotation of the driven roller 16 at the (n+8)th pulse, which is after the subsequent half cycle of the drive roller 14, have the same absolute value except that the signs of the eccentricity components of the drive roller 14 are different. Accordingly, an amount of error of m=1 of the slits 19*a* can be acquired from a difference to an ideal count value when the slits 19*a* are at completely uniform equal intervals, which ideal cont value can be acquired by summing the count value of the n-th pulse and the count value of the (n+8)th pulse and dividing the sum by two. In the same manner, the amount of error of m=2 is acquired from the (n+1)th pulse and the (n+9)th pulse, and the amount of error is continuously acquired for (n+2, n+10), . . . , (n+7, n+15) so as to acquire a total of 8 corresponding to the number of all slits 19*a*, that is, the amounts of error of m=1 to m=8 are determined. Then, in the same manner, the determination of the amounts of error for m=1 to m=8 are made for several timed in several rotation of the drive roller 14, and thus-acquired amounts of error are averaged, and, thereby, the amount of error can be acquired with good accuracy.

Figure 7:
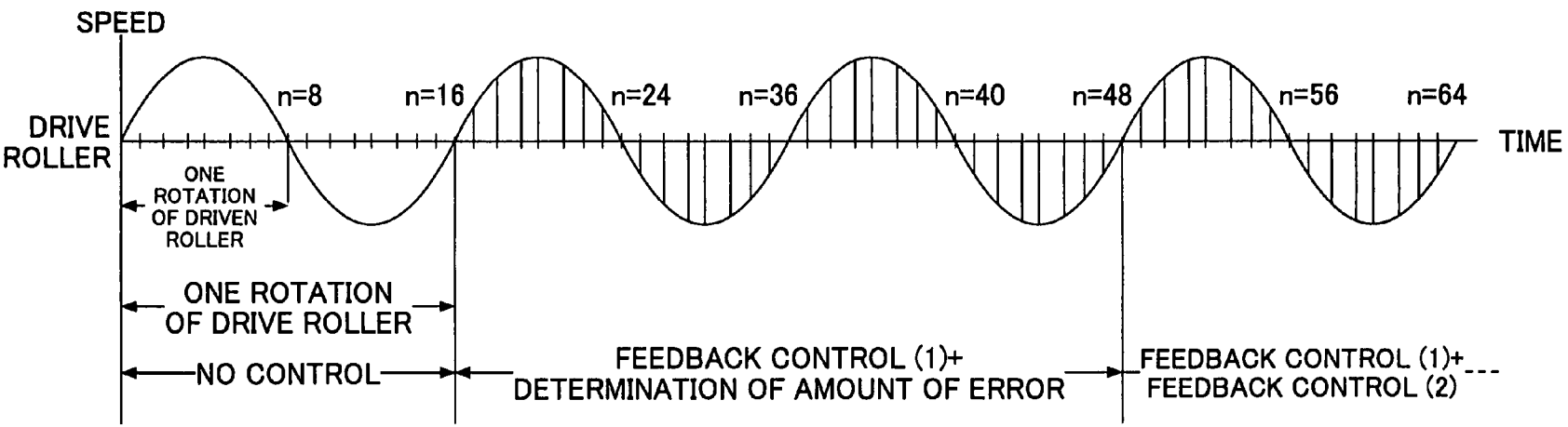
FIG. 7 is a time chart showing a control performed by the control device on the drive roller from a start of counting immediately after a start of a drive motor.

FIG. 7 is a time chart showing a control performed by the control part 3 on the drive roller 14 from a start of counting by the counter part 30 immediately after the start of the drive motor 4.

In order to perform a feedback control (1) based on the moving speed (angular speed) for one rotation cycle of the drive roller 14, passage of the time period corresponding to the one rotation cycle from the start of counting until n=16 is waited, thereby no control is performed. The feedback control (1) is a control for correcting an error due to a gentle speed fluctuation, which is caused by a thermal expansion of the drive roller 14 or the like. When n=16 is reached, the moving speed (angular speed) corresponding to one rotation cycle of the drive roller 14 is acquired first, and the feedback control (1) can be performed from that time. At the same time, from the count value in a half period of the drive roller 14 of n=17 to 24 and the count value in a half period of the drive roller 14 of n=25 to 32, the amounts of error for m=1 to 8 are determined (first time). Additionally, the amounts of error are determined from the count values of a half period of n=25 to 32 and a half period of n=33 to 40 (second time). Further, the amounts of error are determined from the count values of a half period of n=33 to 40 and a half period of n=41 to 48 (third time). The thus-determined amounts of error are averaged (here, averaged by 3). Then, from n=49 until stop of the drive motor 4, a feedback control (2) is performed while previously-acquired amounts of error are corrected sequentially for each interruption of the count by each of the slits 19*a*. The feedback control (2) is a control for correcting the error due to a speed fluctuation caused by the eccentricity of the drive roller 14. After n=48, the above-mentioned feedback control (1) and the feedback control (2) are performed simultaneously.

As mentioned above, according to the above-mentioned control, no control is performed during the first rotation of the drive roller, and the determination of the amount of error is performed during the second and third rotations while performing the feedback control (1), and, thereafter, the feedback control (1) and the feedback control (2) are performed simultaneously in and after the fourth rotation. The determination of the amount of error is not limited to the average of three times, and at least an amount of error determined for the first time may be used. Additionally, by performing the determination of an amount of error for each half period, the same number of times of the determination of an amount of error can be performed within a half of a time period of a case where the determination is performed for each one period.

Figure 8:
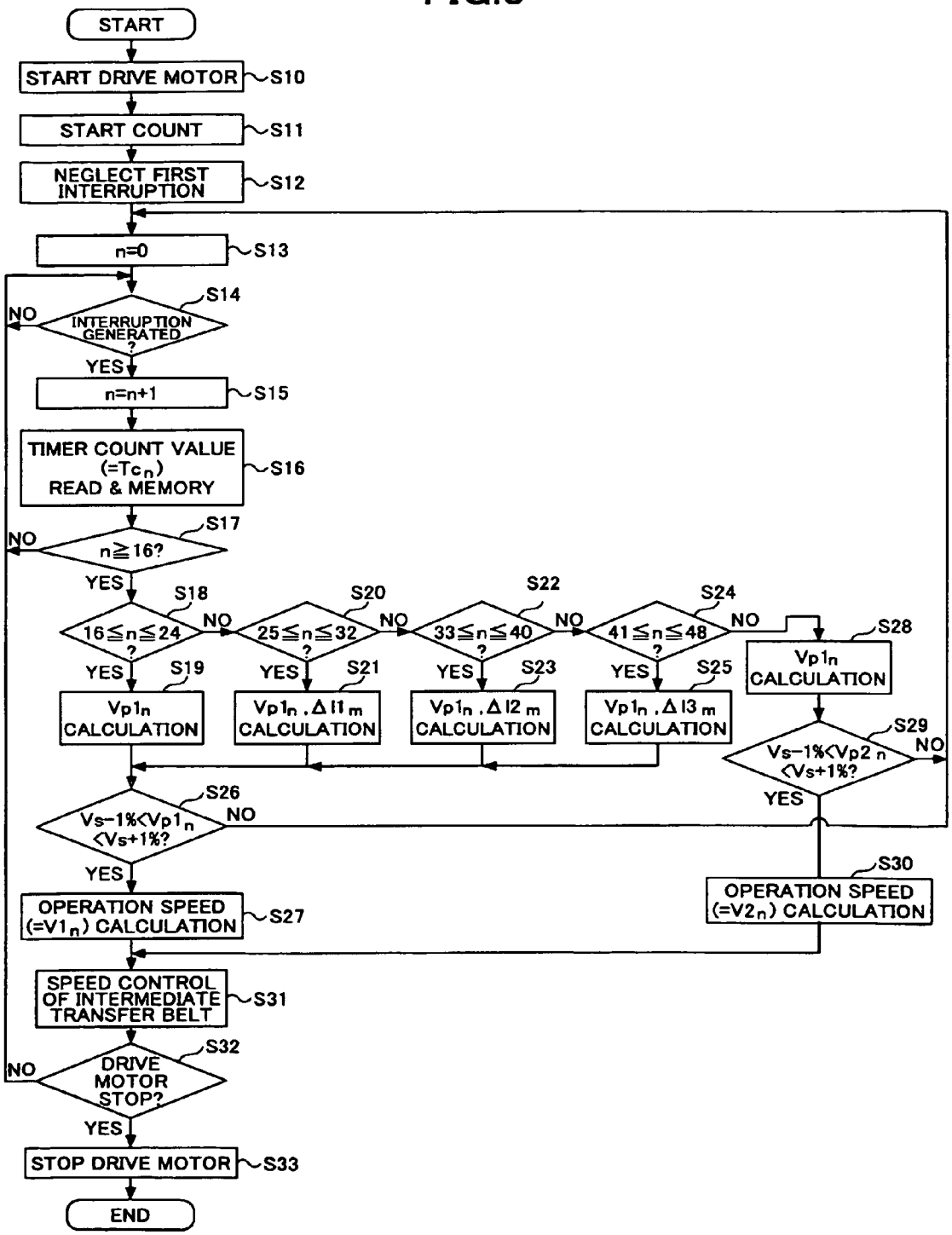
FIG. 8 is a flowchart of a control operation performed by the control device.

FIG. 8 is a flowchart showing an operation of the control part 3 in the present embodiment.

In this control operation, if the drive motor 4 is started in a print operation, etc., and it is stabilized at a constant speed (step S10), a count value by the count clock of the clock 31 is cleared to zero and an interruption by the counter part 30 is permitted and a counter start is set to ON (step S11). The count value at the first interruption is not an accurate value since turning ON of the count operation and a change in the detection signal are not in synchronization with each other. Thus, the control at the first interruption is neglected (step S12), and an interruption count number n is cleared to 0 (step S13).

Then, an interruption from the counter part 30 is waited for (step S14), and when the interruption is generated, the interruption count is incremented by 1, that is, the interruption count number n=n+1 (step S15), and a count value $Tc_n$, which is n-th count value transferred from the counter part 30 to the register and store the value in the RAM 33 (step S16). Subsequently, the interruption count number n is checked, and returns to step S14 until n=16 is reached so as to repeat the process to step S17. That is, if the interruption count number n reaches 16 (if n≦16), it is determined whether or not the interruption count number n is within a range of 16≦n≦24 (step S18).

In this determination, if it is within the range of 16≦n≦24, the process proceeds to step S19, and an angular speed Vp1*n* [mm/s] is calculated from the count value $Tc_n$ read in step S16. Since the count value $Tc_n$ is the count value for each ⅛ rotation of the driven roller 16 (each 1/16 rotation of the drive roller 14), a count value $TC_n$ for one rotation cycle of the drive roller 14 can be acquired by accumulating the count values of the previous sixteen times including the currently read count value as follows.

$$TC_n=Tc_{n-15}+Tc_{n-14}+Tc_{n-13}+\ldots+Tc_{n-2}+TC_{n-1}+Tc_n$$

where, n=16, 17, . . . , 47, 48

If a minimum count time (sampling time) of the count clock is set to Δt [ms], a count time: $T1_n$ [ms] at the count value $TC_n$ corresponding to one rotation cycle of the drive roller 14 is acquired as follows.

$$T1_n\ [\text{ms}]=TC_n\times\Delta t$$

where, n=16, 17, . . . , 47, 48

If the diameter of the driven roller 16+the thickness of the intermediate transfer belt 12 is set to r [mm], the angular speed $Vp1_n$ [mm/s] of the driven roller 16 is acquired as follows.

$$Vp1_n\ [\text{mm/s}]=r\times\pi\times2/T1_n\times1000$$

where n=16, 17, . . . , 47, 48

If it is determined, in step S18, that it is not within the range of 12≦n≦20, the process proceeds to step S20 and it is determined whether or not it is within a range of 25≦n≦32. If it is within a range of 25≦n≦32, the process proceeds to step S21, and the angular speed $Vp1_n$ [mm/s] is calculated similar to step S19, and the amount of error 1: $\Delta I1_m$ is calculated as follows.

$$\Delta I1_m=Tc_s-(Tc_{n-8}+Tc_n)/2$$

where n=25, 26, . . . , 31, 32 m=1, 2, . . . , 7, 8

$Tc_s$ is the ideal count value and is the count value for ⅛ rotation of the driven roller 16 in a case where the intermediate transfer belt 12 is at a constant reference speed and intervals of the slits 19*a* are completely uniform, and $Tc_s$ is calculated as follows.

$$Tc_s=r\times\pi/V_s/\Delta t/8\times1000$$

where r [mm] is a diameter of the driven roller+film thickness of the intermediate transfer belt;

Vs [mm/s] is a reference speed; and

Δt [ms] is a minimum count time of the count clock

If it is determined, in step S20, that it is not within the range of 25≦n≦32, the process proceeds to step S22 where it is determined whether or not it is within 33≦n≦40. If it is within the range of 33≦n≦40, the process proceeds to step S23, and the angular speed $Vp1_n$ [mm/s] is calculated similar to step S19, and the amount of error 2: $\Delta I2_m$ is calculated as follows.

$$\Delta I2_m=Tc_s-(Tc_{n-8}+Tc_n)/2$$

where n=33, 34, . . . , 39, 40 m=1, 2, . . . , 7, 8

If it is determined, in step S22, that it is not within the range of 33≦n≦40, the process proceeds to step S24 where it is determined whether or not it is within 41≦n≦48. If it is within the range of 41≦n≦48, the process proceeds to step S25, and the angular speed $Vp1_n$ [mm/s] is calculated similar to step S19, and the amount of error 3: $\Delta I3_m$ is calculated as follows.

$$\Delta I3_m=Tc_s-(Tc_{n-8}+Tc_n)/2$$

where n=41, 42, . . . , 47, 48 m=1, 2, . . . , 7, 8

Additionally, from the previously acquired amounts of error 1, 2, 3: $\Delta I1_m$, $\Delta I2_m$, $\Delta I3_m$, the amount of error: $\Delta I_m$ is calculated as follows.

$$\Delta I_m=(\Delta I1_m+\Delta I2_m+\Delta I3_m)/3$$

where m=1, 2, . . . , 7, 8

Then, the process proceeds to step S26 to eliminate an error count due to noise or the like. If it is an error count, the process returns to step S13 so as to begin the process again. In step S26, it is determined whether or not $Vp1_n$ is within the limit of ±1% of the reference speed Vs [mm/s]. If it is affirmative (YES), the process proceeds to step S27 to calculate the operation speed $V1_n$ [mm/s]. The calculation is performed as follows. First, a difference value (deviation) $Ve1_n$ [mm/s] to the reference speed Vs [mm/s] is acquired.

$$Ve1_n\ [\text{mm/s}]=Vs-Vp1_n$$

where n=16, 17, . . . , 47, 48

On the other hand, an integral speed $Vei1_n$ [mm/s] to the difference value is acquired as follows.

$$Vei1_n\ [\text{mm/s}]=Ve1_n+Ve1_{n-1}$$

where n=16, 17, . . . , 47, 48

At this time, the difference value $Ve1_n$ and the integral speed $Vei1_n$ to the value difference value are stored in the RAM 33. Accordingly, the operation speed $V1_n$ [mm/s] can be acquired as follows.

$$V1_n\ [\text{mm/s}]=Kp1\times Ve1_n+Ki1\times Vei1_n+Kd1\times(Ve1_n-Ve1_{n-1})+Vs$$

where Kp1 is a proportionality coefficient, Ki1 is an integration coefficient and Kd1 is a differentiation coefficient n=16, 17, . . . , 47, 48

Kp1, Ki1, and Kd1 are previously stored in the RAM 33.

On the other hand, if it is determined, in step S24, that it is not within the range of 41≦n≦48, that is, in a case of n≧49, the process proceeds to step S28 to calculate an angular speed $Vp2_n$ [mm/s] from $Tc_n$ read in step S16. The calculation of $Vp2_n$ is performed as follows. That is, first, $Tc_n$ is sequentially corrected using $\Delta I_m$ acquired in step S25.

$$Tcc_n=Tc_n+\Delta Im$$

where n=49, 50, . . . .

m=1, 2, . . . , 7, 8, 1, 2 . . . .

Since the minimum count time (sampling time) of the count clock is Δt [ms], a count time $T2_n$ [ms] is acquired as follows.

$$T2_n\ [\text{ms}]=Tcc_n\times\Delta t$$

where n=49, 50, . . . .

When (the diameter of the driven roller 16+the thickness of the intermediate transfer belt) is set as r [mm], the angular speed $Vp2_n$ of the driven roller 16 is acquired as follows.

$$Vp2_n\ [\text{mm/s}]=r\times\pi/16\times T2_n\times1000$$

where n=49, 50, . . . .

Then, the process proceeds to step S29 to eliminate, similar to step S26, an error count due to noise or the like. If it is an error count, the process returns to step S13 so as to begin the process again. At this time, similar to step S26, the determination is based on the limit of ±1% of the reference speed Vs [mm/s]. If it is affirmative (YES), the process proceeds to step S30 to calculate the operation speed $V2_n$ [mm/s]. The calculation is the same as that of step S27, and performed as follows.

First, a difference value (deviation) $Ve2_n$ [mm/s] to the reference speed Vs [mm/s] is acquired.

$$Ve2_n\ [\text{mm/s}]=Vs-Vp2_n$$

where n=49, 50, . . . .

An integral speed $Vei2_n$ [mm/s] to the difference value is acquired as follows.

$$Vei2_n\ [\text{mm/s}]=Vei2_n+Ve2_{n-1}$$

where n=49, 50, . . . .

At this time, the difference value $Ve2_n$ and the integral speed $Vei2_n$ are stored in the RAM 33. Accordingly, the operation speed V2. [mm/s] can be acquired as follows.

$$V2_n\ [\text{mm/s}]=Kp2\times Ve2_n+Ki2\times Vei2_n+Kd2\times(Ve2_n-Ve2_{n-1})+Vs$$

where Kp2 is a proportionality coefficient, Ki2 is an integration coefficient and Kd2 is a differentiation coefficient n=49, 50, . . . .

Kp2, Ki2, and Kd2 are previously stored in the RAM 33.

In step S31, an instruction is sent to the motor drive part 34 so as to output a motor drive clock changed from the present speed in accordance with the operation speeds acquired in step S27 and step S30, and, thus, the speed control of the intermediate transfer belt 12 is performed. Then, it is determined, in step S32, whether or not the print operation has ended. If it is determined that the print operation has ended and the drive motor 4 should be stopped, the process proceeds to step S33 so as to stop the drive motor 4, and the process at this time is ended.

As mentioned above, according to the present embodiment, the following effect can be obtained.

1) Since an amount of error in intervals of the slits (objects to be detected) is determined and a control is performed by acquiring the moving time of each slit for each interval while correcting the amount of error, there is no need to make the slits with uniformly equal intervals. Thus, a disk having the slits can be formed at low cost, and the rotation speed of the drive roller (rotation drive member) can be controlled accurately.

2) Since the angular speed is acquired from the integral time corresponding to one cycle of the drive roller and the angular speed is sequentially determined for each interval of the slits (objects to be detected) so as to control for each interval of the slits, it is possible to reduce a speed fluctuation due to various loads to the intermediate transfer belt while determining an amount of error in the intervals of the slits. Thus, the amount of error in the intervals of the slits is not contained, which permits determination of a more accurate amount of error.

3) By performing determination of the amount of error for each time immediately after the drive roller is started, there is no need to completely grasp a stop position of the slits when the intermediate transfer belt is stopped. Accordingly, there is no problem even if the intermediate transfer unit is removed and a user or the like moves the intermediate transfer belt. Additionally, even if an erroneous detection is made due to a noise entering the detection signal indicating each interval of the slits while the intermediate transfer belt is rotating, reattempt can be made easily.

4) By determining the amount of error for several times and averaging the amounts of error, if a speed fluctuation due to various loads to the intermediate transfer belt remains, such a speed fluctuation can be smoothed. Additionally, a speed fluctuation generated within one rotation of the drive roller can be smoothed. Thus, a more accurate amount of error can be determined.

5) When determining an amount of error, the circumference of the drive roller is set to be an even multiple of the circumference of the driven motor so as to cancel a speed component due to eccentricity of the drive roller using a half cycle of the drive roller and a subsequent half cycle of the drive roller. Thereby, the speed fluctuation due to eccentricity of the drive roller can be eliminated from the amount of error, which results in determination of a further accurate amount of error.

The present invention is not limited to the specifically disclosed embodiments, and variations and modifications may be made without departing from the scope of the present invention.

The present application is based on Japanese priority applications No. 2005-198900 filed Jul. 7, 2005 and No. 2006-167992 filed Jun. 16, 2006, the entire contents of which are hereby incorporated herein by reference.

What is claimed is:

1. A drive control device for controlling a rotation speed of a rotatable member, comprising:

a rotation drive member that drives the rotatable member;

a plurality of objects to be detected provided in said rotatable member;

a detector that detects the objects to be detected, which are rotating with rotation of said rotatable member, and outputs a detection signal; and a control part that detects an angular speed of said rotatable member in accordance with the detection signal, and controls a rotation speed of said rotation drive member, wherein said control part calculates an amount of error in intervals of said objects to be detected, controls the rotation speed of said rotation drive member in accordance with the amount of error, uses an average value of values calculated as said amount of error for a plurality of times and performs calculation of said amount of error for each half rotation of said rotation drive member.

2. The drive control device as claimed in claim 1, wherein said control part controls the rotation speed of said rotation drive member while correcting time intervals corresponding to the respective intervals by a time corresponding to the amount of error.

3. The drive control device as claimed in claim 1, wherein while said control part is calculating said amount of error, said control part acquires said angular speed from an integral time corresponding to one rotation of said rotatable member while calculating said amount of error, determines said angular speed sequentially for each interval of said objects to be detected, and performs a control for each interval of said objects to be detected.

4. The drive control device as claimed in claim 1, wherein said control part performs calculation of said amount of error immediately after start-up of the rotation of said rotatable member.

5. The drive control device as claimed in claim 1, wherein said control part performs calculation of said amount of error each time the rotation of said rotatable member is started.

6. The drive control device as claimed in claim 1, wherein said rotatable member is a driven roller that rotates to follow rotation of an intermediate transfer member provided in an image forming apparatus, which transfers an image formed on a photosensitive member onto a recording medium via the intermediate transfer member, and said rotation drive member is a drive roller which drives said intermediate transfer member.

7. The drive control device as claimed in claim 6, wherein a length of an outer circumference of said drive roller is an even multiple of a length of an outer circumference of said driven roller.

8. The drive control device as claimed in claim 7, wherein the length of the outer circumference of said drive roller is twice the length of the outer circumference of said driven roller, and said control part, when calculating said amount of error, cancels a speed fluctuation component caused by eccentricity of said drive roller in accordance with one half of rotation of said drive roller and a subsequent one half of the rotation of said drive roller.

9. An image forming apparatus comprising:

an intermediate transfer belt that is a rotatable endless belt and onto which a toner image is transferred as a primary transfer image;

a drive roller that drives the intermediate transfer belt; a driven roller that rotates with movement of said intermediate transfer belt;

a plurality of objects to be detected that rotate together with the driven roller; and a detector that detects the objects to be detected and outputs a detection signal, wherein said image forming apparatus transfers said primary transfer image that has been transferred onto said intermediate transfer belt onto a recording medium so as to form a secondary transfer image on said recording medium, said image forming apparatus further comprising a control part that detects an angular speed of said driven roller in accordance with said detection signal and controls a rotation speed of said drive roller in accordance with the angular speed, said control part calculating an amount of error in intervals of said objects to be detected, the calculation of the amount of error being performed for each half rotation of said drive roller so as to control a rotation speed of said drive roller in accordance with the amount of error.

* * * * *